United States Patent [19]

Wolford

[11] 4,066,061

[45] Jan. 3, 1978

[54] ASH COLLECTOR COVER AND COMBUSTION ENHANCER FOR A FIREPLACE

[76] Inventor: William E. Wolford, Rte. 3, Box 184 A, Batesville, Ark. 72501

[21] Appl. No.: 737,166

[22] Filed: Oct. 29, 1976

[51] Int. Cl.[2] ..... F23L 5/02

[52] U.S. Cl. ..... 126/135; 110/75 B

[58] Field of Search ..... 126/135, 120, 143, 242–245, 126/121; 110/3.5, 72 R, 75 B; 98/46

[56] References Cited

U.S. PATENT DOCUMENTS

| | | | |
|---|---|---|---|
| 2,103,171 | 12/1937 | Nilson | 126/120 |
| 2,231,258 | 2/1941 | Elmore | 126/121 |
| 2,258,882 | 1/1941 | Craig | 126/121 |
| 2,375,318 | 5/1945 | Mudgett | 126/120 |
| 2,819,711 | 1/1958 | Robinson | 126/163 R |
| 2,985,091 | 5/1961 | Hatcher | 98/46 |

FOREIGN PATENT DOCUMENTS

| | | | |
|---|---|---|---|
| 570,068 | 6/1945 | United Kingdom | 126/120 |
| 402,370 | 11/1933 | United Kingdom | 126/135 |

*Primary Examiner*—Ronald C. Capossela
*Attorney, Agent, or Firm*—Berman, Aisenberg & Platt

[57] ABSTRACT

A combination ash collector cover and combustion enhancer for a fireplace which serves to deliver outside air to the combustion chamber of the fireplace via the ash collector opening. In the preferred embodiment, an outside blower draws in air which is directed through the pressurized ash collector through a unique cover plate having integrally formed air jets extending upwardly therefrom for directing the air to the combustion zone. More particularly, the combination cover-exhaust fits over standard ash collector openings and includes a pair of angularly disposed air pipes centered about a vertical central air pipe about which a brace and poker handle are formed. In the off-season, the combination cover plate and duct assembly may be inverted in the ash collector opening to conceal the exhaust jets therewithin.

14 Claims, 10 Drawing Figures

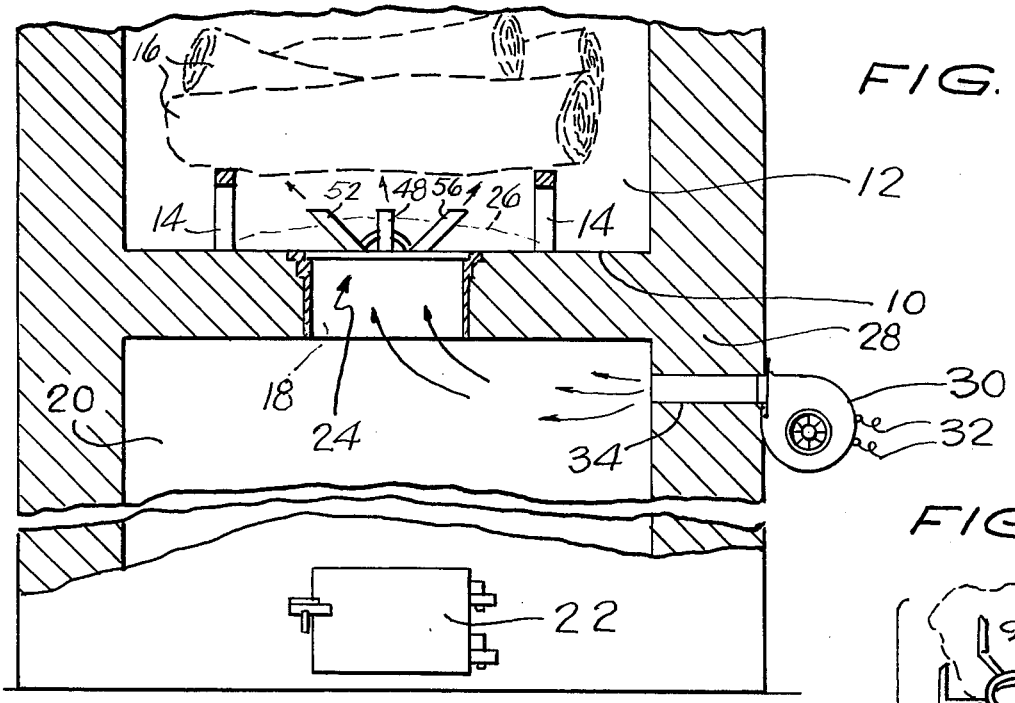
FIG. 1.
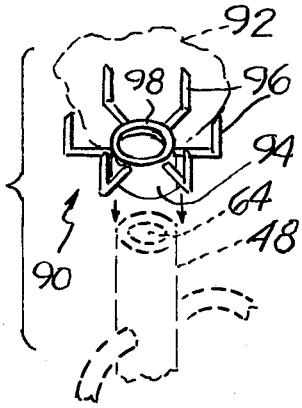
FIG. 10.
FIG. 7.
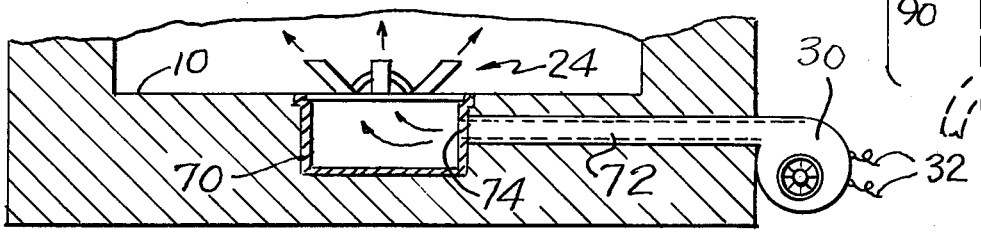
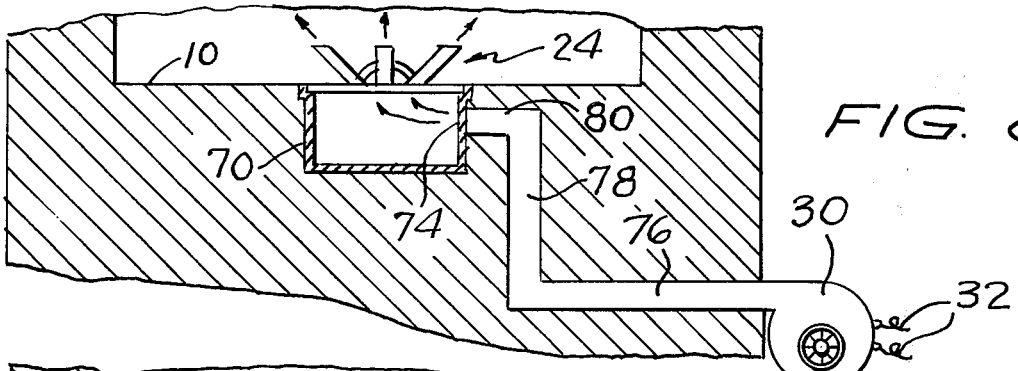
FIG. 8.
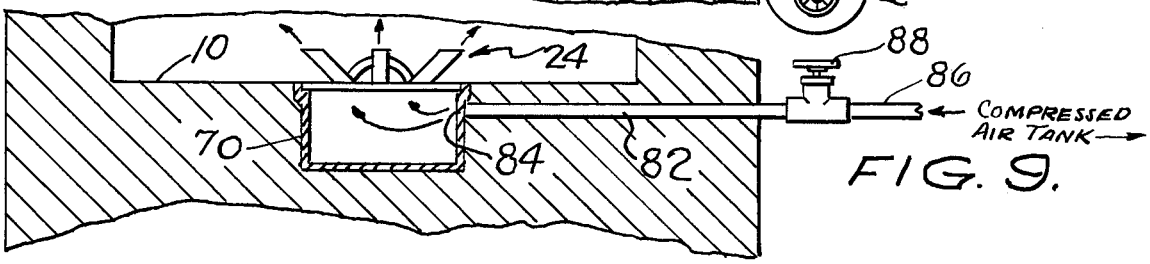
FIG. 9.

ASH COLLECTOR COVER AND COMBUSTION ENHANCER FOR A FIREPLACE

BACKGROUND OF THE INVENTION

1. Field of the Invention

The present invention is related to fireplaces and, more particularly, is directed towards a unique ash dump cover construction which includes means for enhancing the combustion of the fireplace flame.

2. Description of the Prior Art

Many systems have been suggested for enhancing the combustion in a household fireplace. In fact, I am aware of several prior art United States patents in this general area, which include: U.S. Pat. Nos. 186,013; 1,786,453; 2,497,486; 2,819,711; and 3,330,323.

The structures set forth in the above-cited patents include teachings concerning the desirability of providing outside air assisted means to aid in combustion in an indoor fireplace. I have found, however, that each of the above-cited patents set forth structures or systems which suffer from one or more deficiencies. For example, U.S. Pat. No. 1,786,453 illustrates a rather complex forced air means for fireplaces which includes conveyors, stokers, hot water coils, circulating pumps, and the like. Such complexity does not lend itself to economical manufacture, ease of installation, or acceptance by consumers.

The Robinson U.S. Pat. No. 2,819,711 teaches a hearth vent and ash dump combination which, however, is also unduly complex in requiring a multitude of moveable and cooperating parts which subjects the structure to mechanical deterioration, wear, and breakdown. The Robinson structure further requires adjustment at frequent intervals to control the combustion, and adjustment which is difficult to achieve as a result of the location of the parts which require manipulation in the hot combustion zone of the fireplace. This structure also suffers from inherent clogging and concomitant reduced efficiency.

In spite of the proliferation of prior art, it is clear to me that no structure is presently available which is economical to manufacture, easy to install, efficient in operation, has a minimum of moving parts, may be easily incorporated into existing fireplace hearths, and which may be mass produced for universal appeal.

OBJECTS AND SUMMARY OF THE INVENTION

It is therefore a primary object of the present invention to provide a novel and unique ash collector cover and combustion enhancer for a home fireplace which overcomes all of the disadvantages noted above with respect to prior art devices.

Another object of the present invention is to provide an ash collector and combustion enhancer for fireplaces which is simple in construction, economical to manufacture, efficient in operation, and which may be easily adapted to existing fireplace structures.

A further object of the present invention is to provide a combination ash collector cover and combustion enhancer for a fireplace which greatly assists in starting fires, permits continuous operation without clogging, prevents oxygen depletion while reducing heat loss inside the home, and is extremely efficient and economical to operate.

A still further object of the present invention is to provide a combination ash collector cover and combustion enhancer for a home fireplace which may be fitted over either a conventional ash dump in the form of either a large collector pit or a smaller metal receptacle, and further which may be easily stowed during the off-season.

An additional object of the present invention is to provide a combination ash collector cover and combustion enhancer for a home fireplace which, by virtue of the unique fanning action of the combustion zone, increases combustion efficiency, decreases ash accumulation, reduces interior smoke, permits wet wood to ignite more readily, and saves on furnace fuels by producing more heat in the fireplace and preventing heat loss in other areas of the house by reducing air flow therethrough.

The foregoing and other objects are attained in accordance with one aspect of the present invention through the provision of a combination ash collector cover and combustion enhancer for a fireplace, which comprises cover means adapted to be mounted over the ash collector opening of the fireplace, and pipe means extending outwardly from the cover means for placing the combustion chamber in fluid communication with the ash collector. Means are further provided for pressurizing the ash collector whereby air will flow therefrom through the pipe means into the combustion chamber. The pressurizing means in one form comprises an electric blower mounted externally of the ash collector, and conduit means for placing the output of the electric blower in fluid communication with the interior of the ash collector. In an alternative embodiment, the pressurizing means may comprise a source of compressed air, conduit means connected between the source and the ash collector, and means positioned in the conduit for regulating the flow of pressurized air therethrough.

In accordance with other aspects of the present invention, the cover means comprises a substantially planar plate, while the pipe means comprises at least one air pipe forming an air channel one end of which terminates in the plate, the other end of which in use terminates substantially above the plane of the plate. The planar plate is preferably substantially coplanar with the hearth of the fireplace. The planar plate is further preferably substantially rectangular and is adapted to removably fit within a flanged rim formed about the periphery of the ash collector opening. This design permits the planar plate to be inverted when the fireplace is not in use such that the pipe means extend downwardly into the ash collector opening.

In accordance with other and more specific aspects of the present invention, the air pipe extends substantially vertically from the center of the planar plate. More particulary, the pipe means may further include second and third air pipes which are positioned one on each side of the central vertical air pipe and which extend diagonally and outwardly from the planar plate. Means may also be provided for bracing the central air pipe, said bracing means also serving as means for lifting the plate from the ash collector opening by a poker. More particularly, the bracing and lifting means may comprise a pair of curved rods positioned one on either side of the central air pipe and which extends from the base plate to the side wall of the central vertical pipe so as to form a pair of hooks.

In accordance with still other aspects of the present invention, there may be provided means removably positionable on the top of the central air pipe for holding hot coals, whereby initiation of a fire may be further enhanced. The hot coal holding means more specifically may comprise a central annulus positionable about the central pipe and having a plurality of radially and upwardly extending prongs for holding the hot coal therebetween.

BRIEF DESCRIPTION OF THE DRAWINGS

Various objects, features and attendant advantages of the present invention will be more fully appreciated as the same become better understood from the following detailed description thereof when considered in connection with the accompanying drawings, in which:

FIG. 1 is a partially broken, partially sectional side view of one preferred embodiment of the components which comprise the present invention, illustrated in operation;

FIG. 7 is a part sectional side view illustrating an alternative installation which utilizes the principles of the present invention;

FIG. 8 is yet another alternative installation utilizing the preferred embodiment components of the present invention;

FIG. 9 is still another and alternative installation in accordance with the teachings of the present invention; and FIG. 10 is a perspective view which illustrates a preferred embodiment of an auxiliary component constructed in accordance with the teachings of the present invention.

DETAILED DESCRIPTION OF THE PREFERRED EMBODIMENTS

Figure 2:
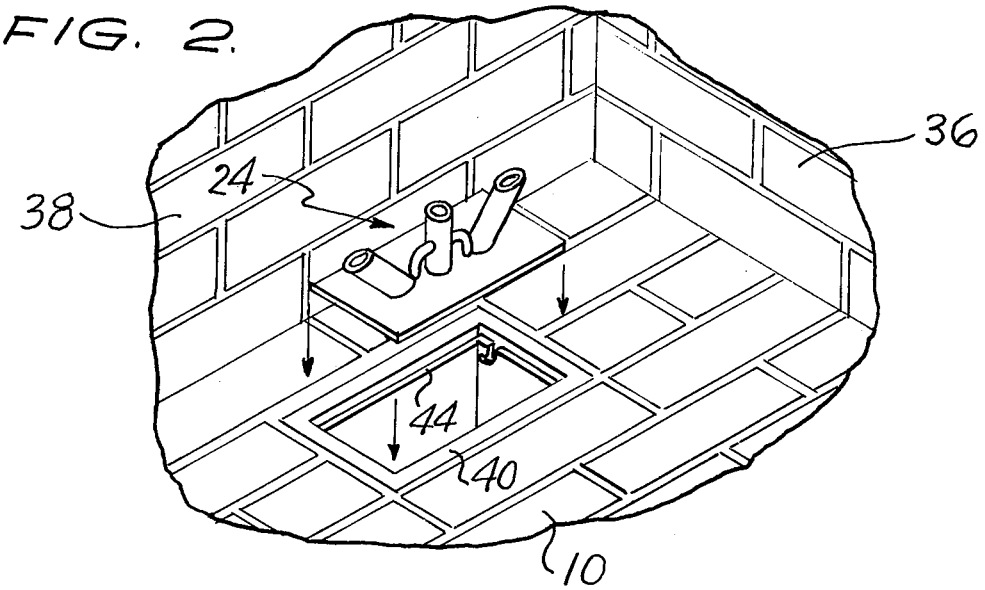
FIG. 2 is a perspective, exploded view of a fireplace hearth which illustrates the manner of installation of a preferred embodiment of the present invention.
Figure 3:
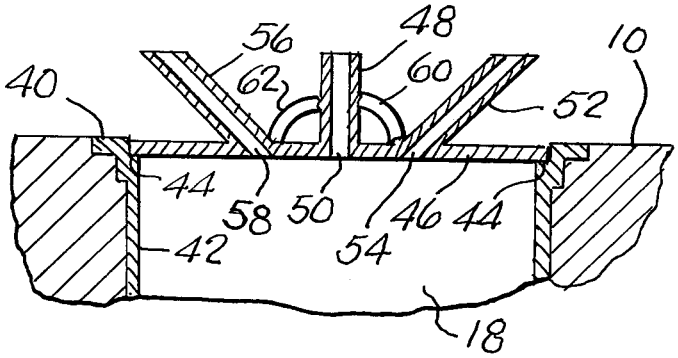
FIG. 3 is a cross-sectional view of a preferred embodiment of the present invention when installed and taken along line 3—3 of FIG. 4.
Figure 4:
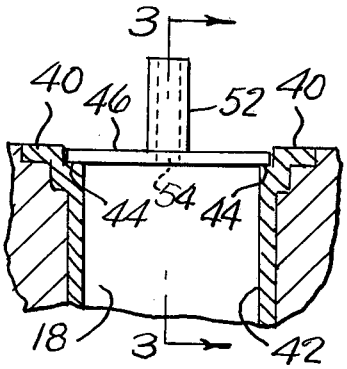
FIG. 4 is a side view in elevation and part-section illustrating the preferred embodiment of the present invention.

Referring now to the drawings, wherein like reference numerals indicate identical or corresponding parts throughout the several views, and more particularly to FIG. 1 thereof, there is illustrated a part sectional, part broken view of a preferred embodiment of the present invention when installed in a conventional fireplace.

More particularly, reference numeral 10 indicates the fireplace hearth or floor above which is located the fireplace combustion chamber 12. Within the combustion chamber 12 are conventionally positioned a pair of parallel andirons 14 upon which are positioned a plurality of wood logs 16 for burning. As is conventional, the logs 16 must be raised several inches from the hearth 10 in order that proper combustion thereof may be initiated and continued.

Conventionally positioned at the center of the floor or hearth 10 of the fireplace, at a position intermediate the andirons 14, is an ash pit opening 18 which, in the illustrated construction, leads to a larger underground ash pit or collector 20. The ash pit opening 18 is conventionally covered by a flat plate which is removed in order to dump the accumulated ashes from the hearth 10 into the ash dump or pit 20. The lower portion of ash pit 20 is provided conventionally with a door 22 for permitting the dump 20 to be cleaned out at desired intervals.

A preferred embodiment of the combination ash pit cover and combustion enhancer of the present invention is indicated generally in FIG. 1 by reference numeral 24. It may be appreciated by its positioning over ash pit opening 18 that it is intended to replace the conventional ash pit cover plate. The combination ash pit cover and combustion enhancer 24 is unique in providing, in the preferred embodiment illustrated, three air pipes indicated by reference numerals 48, 52 and 56, the structure of which will be described in more detail hereinafter. The air pipes 48, 52 and 56 place the interior of the ash pit 20 in fluid communication with the combustion chamber 12 of the fireplace such that air may be supplied from the former to the latter.

To this end, an electric blower 30 is preferably provided externally of the fireplace and includes a pair of leads 32 which may be connected to any convenient source of electrical power (not shown). Further, the actuation and/or speed of electric blower 30 may be controlled by conventional electric switches, or the like (not shown).

The output air from electric blower 30 is fed via an air channel or conduit 34 positioned within the fireplace side wall 28 to the interior of the ash collector pit 20. The flow of air from blower 30 to ash pit 20 pressurizes the latter in order that a controlled stream of air may be delivered through air pipes 48, 52 and 56 to initiate or enhance combustion of the wood 16 within the fireplace combustion chamber 12.

Note in particular that the top portions of the conduits 48, 42 and 56 extend substantially above the level of the floor or hearth 10 of the fireplace. In fact, the height of the air pipes 48, 52 and 56 preferably extends at least 2 inches above hearth 10 such that a desirable buildup of ashes 26 on the hearth 10 floor may occur without clogging the pipes or reducing the effectiveness of the operation of the system of the present invention.

Referring now more particularly to FIGS. 2 through 5, the details of construction of the combination ash pit cover and combustion enhancer 24 of the present invention will now be explained. FIG. 2, in particular, illustrates the manner of installation of the ash pit cover and combustion enhancer 24 on the fireplace hearth 10. The fireplace includes a side wall 36 of fire brick as well as a rear wall 38 contructed on the same material. Positioned in the floor 10 is a substantially rectangular ash dump rim 40 which is conventionally manufactured in a standard size (approximately $4\frac{3}{8}$ inches wide and $8\frac{5}{8}$ inches long). The center line of ash pit rim 40 extends approximately $11\frac{1}{2}$ inches from the rear wall 38 of the fireplace.

The ash pit opening 18 is preferably provided with a liner 42, constructed of metal or the like, which may extend integrally from the rim 40 of the ash pit opening. Joining the rim 40 and liner 42 is a peripherally extending lip or flange 44 upon which the ash pit cover and combustion enhancer 24 of the present invention may be seated.

The preferred embodiment of the present invention more particularly comprises a substantially planar base plate 46 which is dimensioned so as to fit within the flange 44 of the ash pit opening 18. At least one pipe 48 extends upwardly from the central portion of base plate 46 so as to form an air conduit 50 which places the ash pit opening 18 in fluid communication with the output opening 64 of conduit 50.

Positioned on either side of central vertical pipe 48 are a pair of diagonal and outwardly extending pipes 52 and 56 which respectively form a pair of air conduits 54 and 58 which also place the interior of the ash pit opening 18 in fluid communication with their end openings 66 and 68, respectively. Pipes 48, 52 and 56 may respectively be ½ inch diameter pipes and may be conveniently integrally formed with base plate 46 of cast iron.

Figure 6:
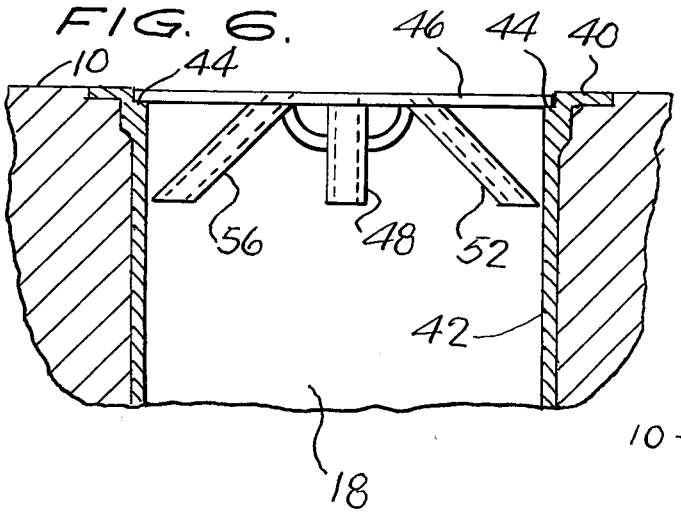
FIG. 6 is a side view in partial section which illustrates an alternative installation of the preferred embodiment of the present invention.
Figure 5:
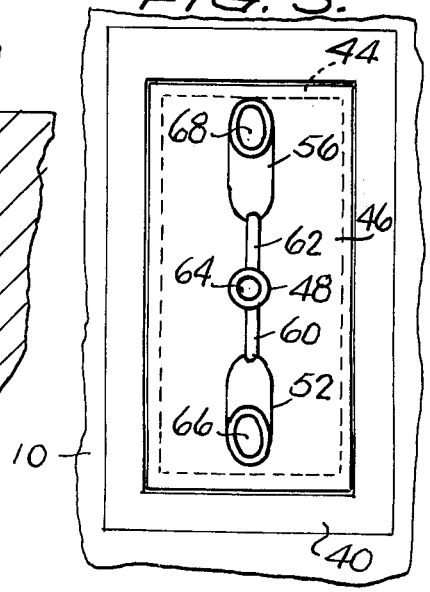
FIG. 5 is a top view of the preferred embodiment of the present invention illustrated in FIG. 4.

Positioned on either side of the central vertical air pipe 48 are a pair of braces indicated by reference numerals 60 and 62 which also serve as a means for lifting the base plate 46 with a poker or the like. Attention is directed to FIG. 6 which illustrates the unique design of the present invention which permits its inversion during the off-season so as to be easily stowed within collector opening 18 as illustrated.

Referring now to FIG. 7, an alternative installation of the present invention is illustrated in which the fireplace is provided with a metal ash box 70 formed below hearth 10, ash box 70 being typically on the order of 3 inches by 8 inches by 8 inches. An ash collector liner is also preferably provided for permitting easy cleaning of the metal ash box 70. Blower 30 is in communication with the interior of ash box 70 via a conduit 72 whose entry 74 into box 70 is near the top portion of the latter in order to prevent clogging of the air pipes.

FIG. 8 illustrates yet another alternative installation of the present invention in a raised hearth fireplace wherein conduit 72 comprises a pair of horizontal sections 76 and 80 between which a vertical section 78 is connected.

FIG. 9 illustrates schematically an alternative mode of providing the desired air flow to the combustion chamber of the fireplace in the form of compressed air. A compressed air tank (not shown) is connected to a line 86 which is, in turn, connected via a control valve 88 to tubing 82 positioned within the fireplace structure. Tubing 82 outlets at 84 to the upper portion of box 70, in a fashion analagous to the constructions of FIGS. 7 and 8 described hereinabove.

Referring now to FIG. 10, there is illustrated a preferred embodiment of an attachment to the basic combination ash pit cover and combustion enhancer 24 which may be broadly described as a removable rack indicated generally by reference numeral 90. Rack 90 is provided for holding a hot coal or coals, indicated in dotted outline by reference numeral 92, in a raised relation to the output 64 of central pipe 48 in order to further assist in the ignition of a fire within the combustion chamber 12 of the fireplace. More particularly, the rack 90 comprises a central ring-shaped annulus 94 which is of a diameter sufficient to fit about the upper portion of vertical pipe 48. For seating purposes, annulus 94 may be provided with a seating flange or lip 98 extending inwardly from the upper portion thereof. Extending outwardly from the peripheral body of annulus 94 are a plurality of L-shaped rods or prongs 96 which are designed to hold a hot coal or coals therein. The air exhausting from outlet 64 of pipe 48 further assists in maintaining the coal 92 in an ignited state while the wood logs 16 are ignited.

It may be appreciated from the foregoing that the present invention, in providing an integral combination ash pit cover and combustion enhancer, directs forced air towards the underside of the fireplace logs 16 with a unique fanning action to initiate and sustain combustion. Combustion efficiency is greatly enhanced to minimize the formation and accumulation of ash and smoke, as well as to minimize heat loss and furnace fuel burning in the home. The directional placement of the jets permits a fanning effect over a large area of the underside of the firewood 16 and permits the plate 46 to be manufactured in the standard size of presently existing ash dump cover lids, which increases its attractiveness to preexisting installations. The extension of the air conduits an appreciable distance above the plane of the hearth 10 permits a desirable buildup of ashes on the floor of the hearth and eliminates undesirable distribution of the ashes to the room while simultaneously preventing clogging of the air conduits. The forced air from the blower permits easier ignition by providing a proper updraft prior to ignition. The present invention, as a result of normal heat convection, may provide sufficient air supply to a properly burning fire without requiring continuous operation of the fan.

Obviously, numerous modifications and variations of the present invention are possible in light of the above teachings. It is therefore to be understood that within the scope of the appended claims, the invention may be practiced otherwise than as specifically described herein.

I claim as my invention:

1. In combination with a fireplace having a hearth, a combustion chamber position above said hearth, an ash collector positioned below said hearth, and an opening formed in said hearth leading to said ash collector, the improvement which comprises a combination ash collector cover and combustion enhancer, which comprises:

cover means comprising a substantially planar plate removably positioned over said ash collector opening of said fireplace;

pipe means comprising at least one air pipe extending outwardly from said plate for placing said combustion chamber of said fireplace in fluid communication with said ash collector, said at least one air pipe forming an air channel one end of which in use terminates below said combustion chamber but substantially above the plane of said plate for permitting ashes to accumulate on said plate without clogging said pipe; and means for pressurizing said ash collector for causing air to flow therefrom through said pipe means into said combustion chamber so as to enhance combustion therein.

2. The combination ash pit cover and combustion enhancer as set forth in claim 1, wherein said pressurizing means comprises an electric blower mounted externally of said ash collector, and conduit means for placing the output of said electric blower in fluid communication with the interior of said ash collector.

3. The combination ash pit cover and combustion enhancer as set forth in claim 1, wherein said pressurizing means comprises a source of compressed air, conduit means connected between said source and said ash collector, and means positioned in said conduit means for regulating the flow of air therethrough.

4. The combination ash pit cover and combustion enhancer as set forth in claim 1, wherein said planar plate is in use substantially coplanar with the hearth of said fireplace.

5. The combination ash pit cover and combustion enhancer as set forth in claim 4, wherein said ash collector opening includes a flanged rim formed about its periphery and said planar plate is substantially rectangular and is adapted to removably fit within said flanged rim.

6. The combination ash pit cover and combusion enhancer as set forth in claim 5, wherein said planar plate includes means for permitting same to be inverted when said fireplace is not in use such that said pipe means extend downwardly into said ash collector opening.

7. The combination ash pit cover and combustion enhancer as set forth in claim 1, wherein said one air pipe extends substantially vertically from the center of said planar plate.

8. The combination ash pit cover and combustion enhancer as set forth in claim 7, wherein said pipe means further comprises second and third air pipes positioned one on each side of said one air pipe and extending diagonally outwardly from said plate.

9. The combination ash pit cover and combustion enhancer as set forth in claim 8, further comprising means for bracing said one air pipe which also serves as means for lifting said plate from said ash collector opening.

10. The combination ash pit cover and combustion enhancer as set forth in claim 9, wherein said bracing and lifting means comprises a pair of rods positioned one on either side of said one air pipe and extending from said plate to the side wall of said one air pipe.

11. The combination ash pit cover and combustion enhancer as set forth in claim 7, further comprising means located at the top of said one air pipe for holding hot coal means whereby initiation of a fire may be further enhanced.

12. The combination ash pit cover and combustion enhancer as set forth in claim 11, wherein said hot coal holding means comprises annulus positionable about said one air pipe and having a plurality of radially and upwardly extending prongs.

13. The combination ash pit cover and combustion enhancer as set forth in claim 1, wherein said ash collector comprises a relatively large ash dump having a clean out door positioned at the bottom thereof, said ash collector opening being of relatively reduced dimensions with respect to those of said ash dump positioned therebelow.

14. The combination ash pit cover and combustion enhancer as set forth in claim 1, wherein said ash collector comprises a metal ash box of substantially the same length and width as said ash collector opening.

* * * * *